United States Patent [19]

Johnson

[11] Patent Number: 4,642,969

[45] Date of Patent: Feb. 17, 1987

[54] METHOD AND APPARATUS FOR WRAPPING BLOCKS OF CHEESE

[76] Inventor: Charles H. Johnson, Hwy. 51 & Leigh Rd., Hazelhurst, Wis. 54531

[21] Appl. No.: 716,810

[22] Filed: Mar. 27, 1985

[51] Int. Cl.[4] ..... B65B 31/04; B65B 53/02

[52] U.S. Cl. ..... 53/433; 53/442; 53/511; 53/528; 53/550; 53/568

[58] Field of Search ..... 53/510, 511, 548, 550, 53/562, 567, 568, 432, 433, 442, 557, 526, 528; 198/626

[56] References Cited

U.S. PATENT DOCUMENTS

| | | | |
|---|---|---|---|
| 2,660,219 | 11/1953 | Haas et al. | 154/42 |
| 3,007,295 | 11/1961 | Heinzer | 53/180 |
| 3,090,174 | 5/1963 | Kraft | 53/433 |
| 3,303,630 | 2/1964 | Harm | 53/28 |
| 3,782,070 | 1/1974 | Erlandson | 53/557 |
| 3,785,276 | 1/1974 | Noor | 53/557 |
| 3,800,498 | 4/1974 | Suzuki | 53/550 |
| 3,869,038 | 3/1975 | Piper et al. | 198/626 |
| 3,943,686 | 3/1976 | Crawford et al. | 53/182 |
| 3,958,390 | 5/1976 | Pringle, Jr. et al. | 53/511 |
| 4,073,116 | 2/1978 | Glover | 53/182 R |
| 4,483,125 | 11/1984 | Suga | 53/550 |

*Primary Examiner*—John Sipos
*Assistant Examiner*—Donald R. Studebaker
*Attorney, Agent, or Firm*—Andrus, Sceales, Starke & Sawall

[57] ABSTRACT

Blocks of cheese are entubed in relatively thin plastic film wrapping material that is heat shrinkable and sealable. According to the method and apparatus, the entubed blocks of cheese are heated to tightly shrink the wrap onto the blocks of cheese to drive air out from between the cheese and the film wrap to provide for good shelf-life and to maintain flavor and other qualities of the product.

17 Claims, 17 Drawing Figures

FIG. 4
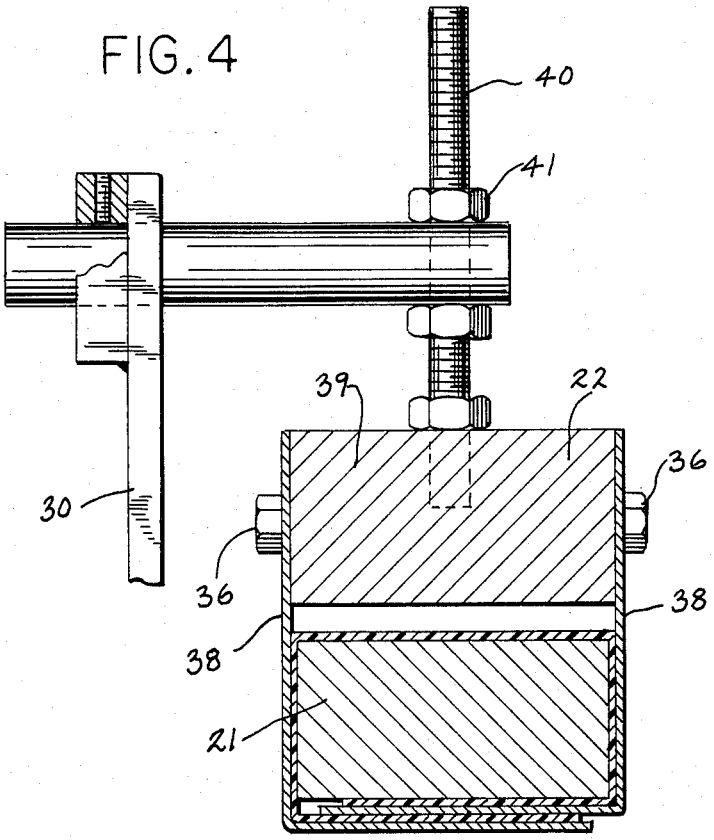
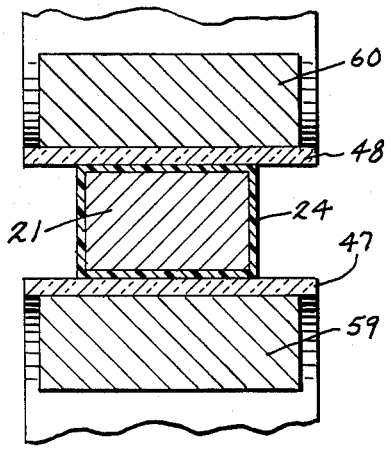
FIG. 5
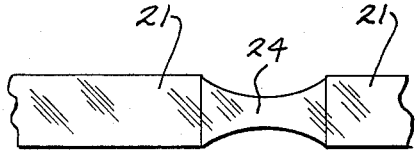
FIG. 6
FIG. 7
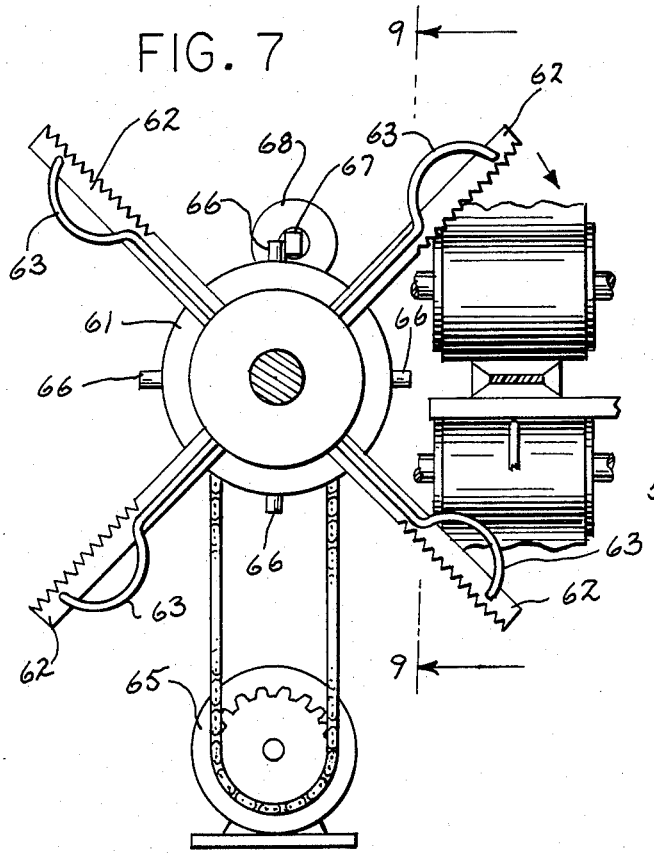
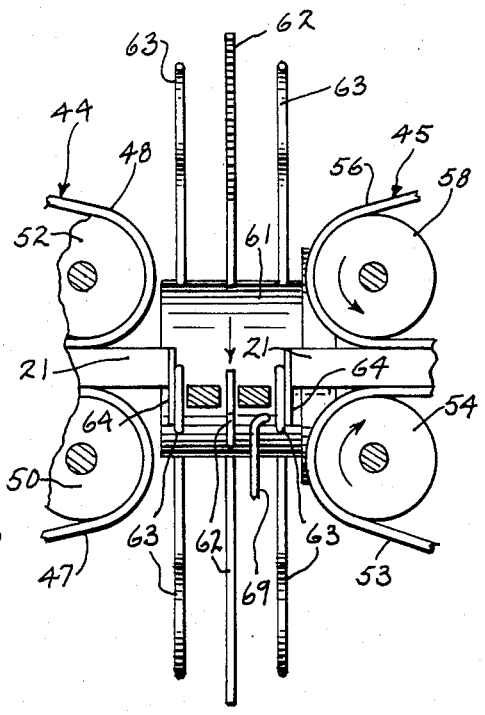
FIG. 8

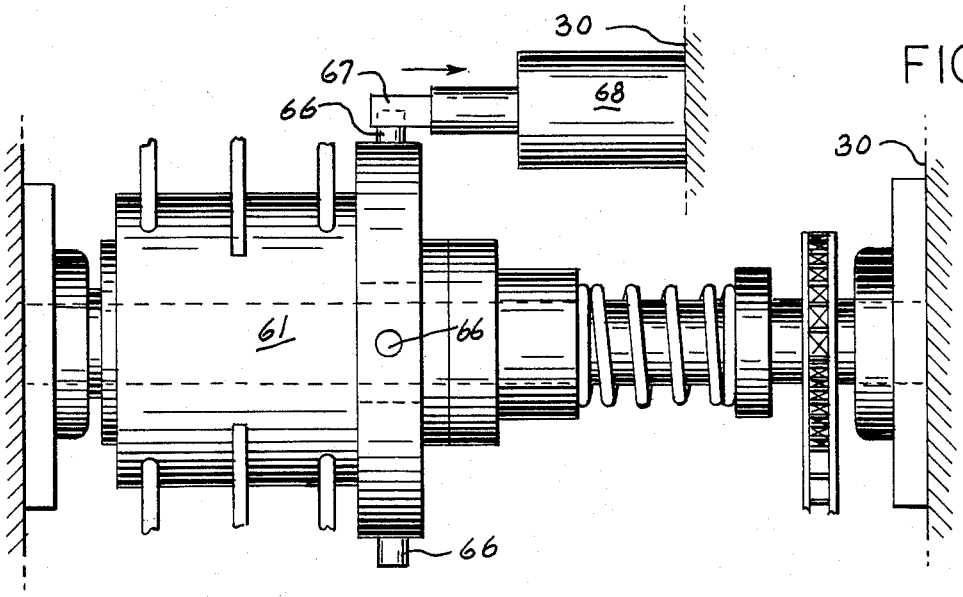
FIG. 9
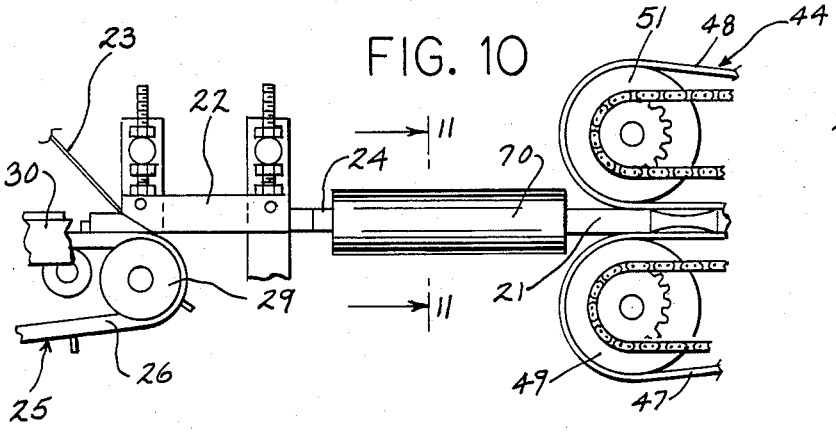
FIG. 10
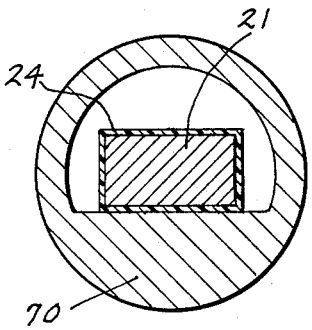
FIG. 11
FIG 12
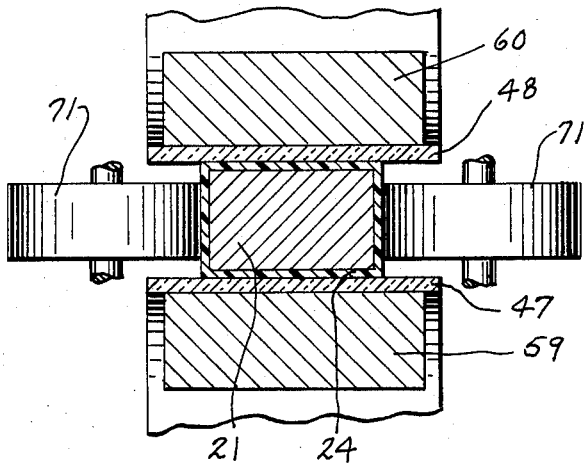
FIG. 13
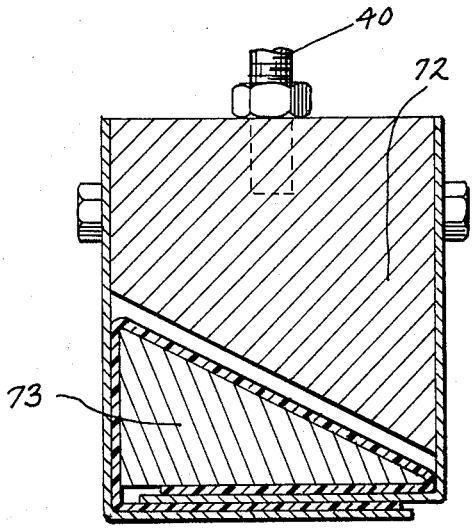

METHOD AND APPARATUS FOR WRAPPING BLOCKS OF CHEESE

BACKGROUND OF THE INVENTION

This invention relates to a method and apparatus for wrapping a succession of advancing articles such as blocks of cheese with a heat shrinkable and sealable plastic film wrap.

When wrapping blocks of cheese, it is essential to remove from and keep out of the package as much air as possible so as to eliminate or at least greatly delay spoilage and provide for good shelf-life even while maintaining the flavor and other qualities of the product. It is generally an object of this invention to provide a method and apparatus for wrapping blocks of cheese in a heat shrinkable and sealable plastic film wrap to form a package that offers a product environment of minimal air and presents the product attractively.

SUMMARY OF THE INVENTION

Broadly, the method and apparatus for wrapping articles such as blocks of cheese contemplate the use of tube former means. Means are provided for feeding blocks of cheese into the tube former means. There are means also for feeding a web of heat shrinkable and sealable plastic film wrap to the tube former means for entubement of the spaced blocks of cheese in an elongated tube of the plastic film wrap. The film wrap includes lateral edge portions of the web that overlap each other over the length of the tube. There are conveyor means for advancing the entubed spaced blocks of cheese from the tube former means to a cut-off station. Heating means are associated with the conveyor means to thereby shrink the plastic film wrap tightly onto the surfaces of the blocks of cheese extending in the direction of travel to drive air out from between the cheese and the film wrap and to seal the overlapped edge portions of the wrap as the entubed blocks of cheese are advanced on the conveyor means toward the cut-off station. Means are provided at the cut-off station for severing the tube corresponding to each block of cheese with the severance being effected intermediate the space between adjacent blocks and leaving each block with opposed severed tube ends. Means are further provided for folding the severed tube ends against a surface of each wrapped block of cheese extending in the direction of travel. There are means also for heating the separate wrapped blocks of cheese to seal the tube ends and secure the ends to the adjacent surface.

DESCRIPTION OF THE DRAWING FIGURES

The drawings furnished herewith illustrate the best mode presently contemplated for the invention and are described hereinafter.

In the drawings:

FIG. 4 is an enlarged sectional view taken generally on line 4—4 of FIG. 1;

FIG. 5 is an enlarged sectional view taken generally on line 5—5 of FIG. 1;

FIG. 6 is a detail side elevation showing generally the taut hourglass-shaped or necked down condition of the shrunk plastic film wrap that prevails in the space between the entubed adjacent blocks of cheese as a consequence of heating;

FIG. 7 is an enlarged sectional view taken generally on line 7—7 of FIG. 1 and shows the film cut-off mechanism;

FIG. 8 is an enlarged side elevation of the film cut-off mechanism;

FIG. 9 is an enlarged view taken generally on line 9—9 of FIG. 7;

FIG. 10 is a side elevation and shows an embodiment of the wrapping machine wherein the film enveloped product passes through a tunnel-like heating element prior to their entry to the heated conveyors;

FIG. 11 is an enlarged sectional view taken generally on line 11—11 of FIG. 10;

FIG. 12 is a sectional view and shows an embodiment wherein heating rollers engage with opposed sides of the film enveloped blocks of cheese normal to the sides engaged by the opposed conveyor belts;

FIG. 13 is a partial sectional view similar to a portion of FIG. 4 and shows a tube former element for a wedge-shaped block of cheese;

DESCRIPTION OF THE ILLUSTRATED EMBODIMENT

Figure 1:
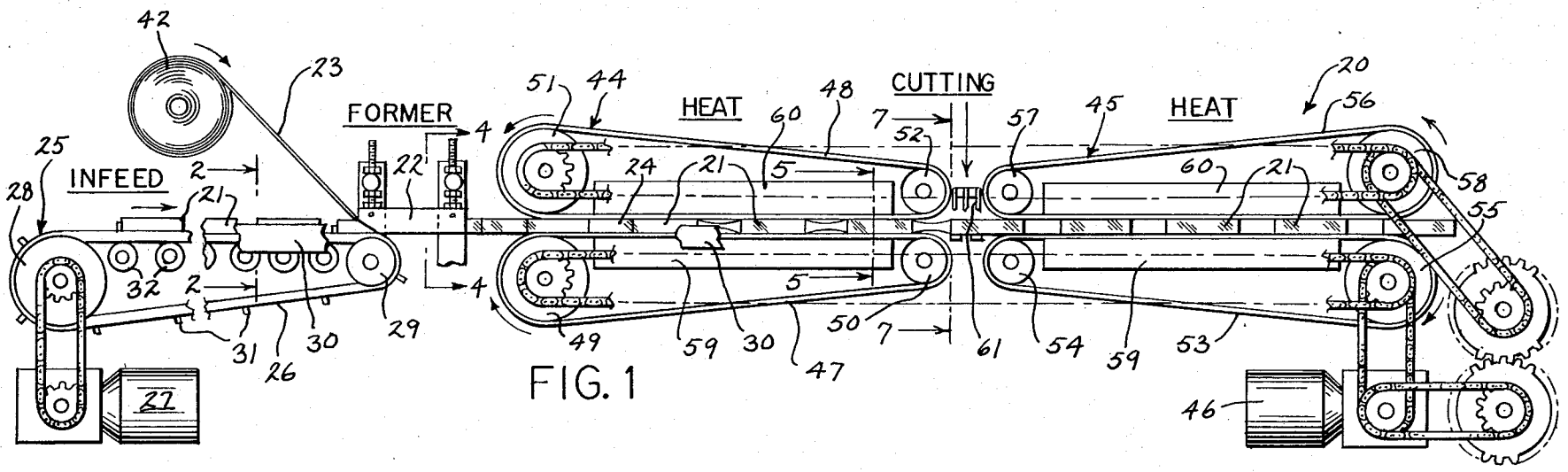
FIG. 1 is a side elevational view generally showing the wrapping machine of the invention.

Referring to the drawings, the wrapping apparatus 20 provides for the wrapping of individual articles such as blocks of cheese 21.

The wrapping apparatus 20 generally comprises a tube former 22 which receives a web of wrapping material 23 and forms the same into a continuous wrapping tube 24. The apparatus 20 further includes an infeed conveyor 25 which carries the spaced blocks of cheese 21 into the tube former 22 wherein the spaced blocks are continuously entubed within the wrap material 23. Thereafter the wrapping material tube 24 is heat shrunk onto the blocks of cheese 21 to displace air, severed between the blocks and cling sealed in a manner to generally preclude ingress of air into the resulting packages.

The infeed conveyor 25 generally comprises an endless belt 26 driven by the motor 27 and a suitable drive mechanism between the longitudinally spaced pulleys 28 and 29 mounted to the frame 30. The belt 26 carries a plurality of spaced pusher elements 31 each of which engages with the trailing end of a block of cheese 21 to advance the blocks toward and into the tube former 22 in the longitudinally spaced relation desired. The upper reach of the conveyor belt 26 may be supported by a plurality of longitudinally spaced idler rollers 32.

Figure 2:
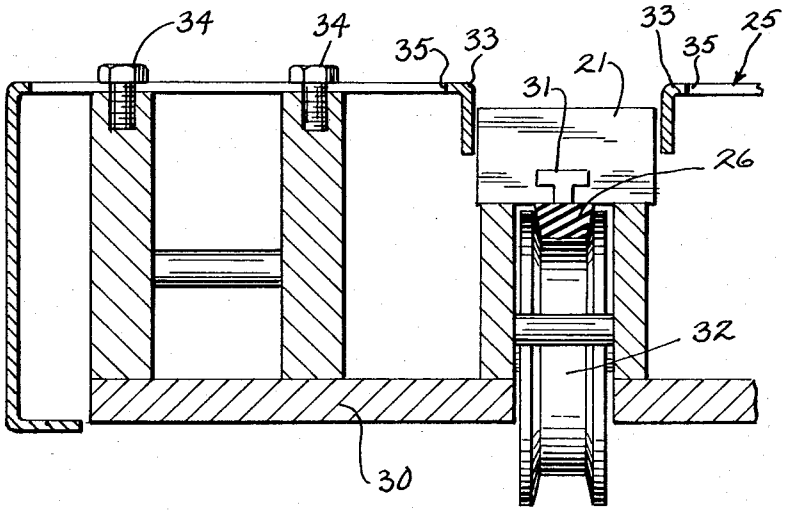
FIG. 2 is an enlarged sectional view taken generally on line 2—2 of FIG. 1.

To properly align the blocks of cheese 21 in the transverse direction relative to the tube former 22, a pair of transversely spaced guide elements 33 are secured to the frame 30 by the threaded members 34 as generally shown in FIG. 2. The guide elements 33 are provided with transversely extending slots 35 providing for transverse adjustability of the elements relative to the frame 30 to accommodate blocks of cheese 21 of any desired width.

Figure 3:
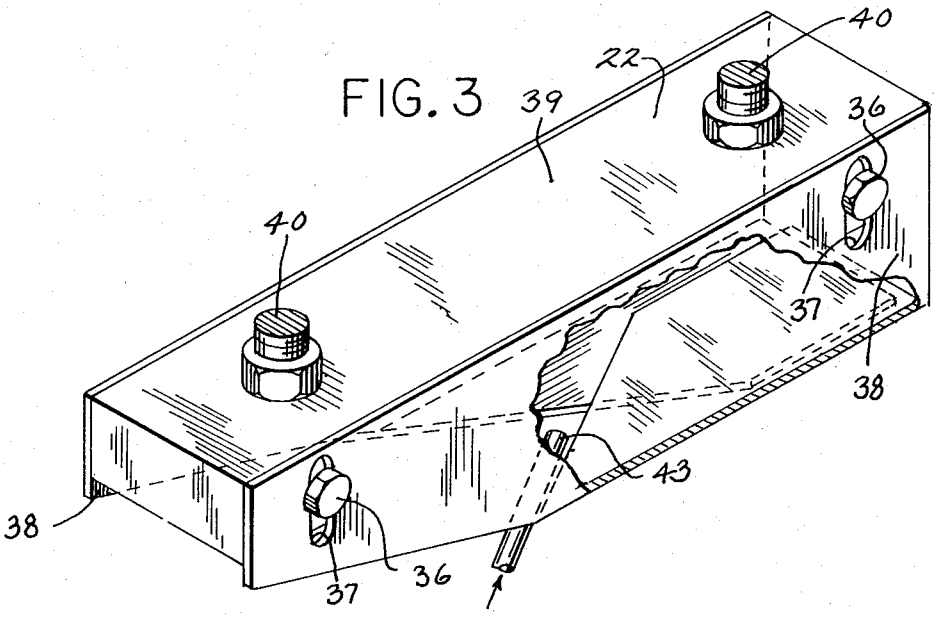
FIG. 3 is an enlarged perspective view of the tube former element within which a plastic film wrap forms a continuous or endless tube for enveloping successive advancing spaced blocks of cheese.

The blocks of cheese 21 are fed by the infeed conveyor 25 into the tube former 22 carried on the frame 30. As perhaps best shown in FIG. 4, the tube former 22 causes the web of wrap material 23 to envelop the incoming spaced blocks of cheese 21 and provides for overlap of the opposed edge portions of the web of the film wrap in the transverse direction and extending over the full length of the wrapping tube 24 and beneath the blocks of cheese. As shown in FIGS. 3 and 4 the tube former 22 is vertically adjustable as provided for by the pin 36 and slot 37 mounting connection between the respective side members 38 and the tube former frame 39, and the frame 39 in turn is vertically adjustable relative to the frame 30 by the threaded member support 40 and nut 41 connection so that the tube former is adjustable to accommodate blocks of cheese 21 of a desired height or depth.

The wrapping material is a relatively thin or light gauge heat shrinkable and heat sealable clear plastic film such as polyethylene or the like. The gauge thickness of the plastic film wrap is on the order of 100 gauge or less.

As the web of wrapping material 23 is pulled from the source roll 42 disposed generally above the infeed conveyor 25 into the tube former 22 and just prior to closure of the wrapping tube 24, around the advancing spaced blocks of cheese 21, a suitable gas may be introduced into the tube and around the blocks of cheese 21 to initially purge and thereby displace at least some of the air present within the wrapping tube. In FIG. 3, a nozzle 43 is shown in position beneath the tube former 22 for introduction of carbon dioxide or other suitable purging gas.

Downstream from the tube former 22, the entubed blocks of cheese 21 pass through a further pair of conveyors 44 and 45 supported by the frame 30 and driven by suitable drive means including the motor 46. The conveyors 44 and 45 are longitudinally aligned and longitudinally aligned with the infeed conveyor 25. The blocks of cheese 21, therefore, experience no change in direction and thus move straight-through or in-line for packaging.

The initial conveyor 44 downstream from the tube former 22, comprises a pair of vertically opposed endless belts 47 and 48. The lower belt 47 is trained on longitudinally spaced pulleys 49 and 50 and moves clockwise, while the upper belt 48 is trained on the spaced pulleys 51 and 52 and moves counterclockwise. The upper reach of the belt 47 and the lower reach of the belt 48 are suitably spaced vertically to firmly grip or clamp the blocks of cheese 21 therebetween as generally shown in FIG. 5 to advance the blocks and thereby pull the web of plastic film wrap 23 through the tube former 22 to continuously entube the spaced blocks of cheese fed into the tube former by the infeed conveyor 25. The upper belt 48 is vertically adjustable to accommodate a range of heights for the blocks of cheese 21, and guide elements 33 are transversely adjustable relative to the frame 30 to accommodate a range of widths.

The conveyor 45 is in most respects similar to conveyor 44 and includes a lower endless belt 53 trained on pulleys 54 and 55 and moves clockwise, while the vertically opposed upper endless belt 56 trained on pulleys 57 and 58 moves counterclockwise. The belts 53 and 56 of conveyor 45 similarly grip the blocks of cheese 21 therebetween for advancement in the downstream direction.

As much air as possible should be driven from the packages containing the blocks of cheese 21 so as to provide the packaged products with an adequate shelf-life and to maintain its flavor and other qualities. To that end heat is supplied at the conveyors 44 and 45 to shrink the film wrap tightly onto the blocks of cheese and seal the plastic film wrap.

To supply the needed heat, electrically energized hot plates 59 and 60 are disposed in opposed relation in the conveyor 44. The hot plate 59 is disposed between the pulleys 49 and 50 of the endless belt 47 and serves as the support for the upper reach of that belt. The hot plate 60 is disposed between the pulleys 51 and 52 of the endless belt 48 and serve as the support for the lower reach of that belt. Since the belts 47 and 48 are to withstand and yet impede as little heat as possible emanating from the hot plates 59 and 60, it is contemplated that they may be fabricated from fiberglass or the like.

The conveyor 45 is similarly provided with opposed hot plates 59 and 60.

During operation of the apparatus 20, it is contemplated that the hot plates 59 and 60 will develop heat in the range of up to 220° F. In the conveyor 44, the heat effects shrinkage of the tubular film wrap 24 and a good cling seal at the overlapped edge portions of the film wrap. The shrinkage of the tubular plastic film wrap 24 will be tightly onto the longitudinally extending surfaces of the blocks of cheese 21 to drive any gases and most especially air out from between the cheese and the wrap. The heat will also liquify the surface fat on the blocks of cheese 21 which serves to seal against the film wrap and thus assist to drive out gases from between the cheese and wrap. The shrinkage of the tubular film wrap 24 effects a taut hourglass shape or necked down condition of the wrap in the space between adjacent blocks of cheese 21 as best shown in FIG. 6 to make the subsequent cutoff operation easier.

The entubed blocks of cheese 21 are separated between the conveyors 44 and 45 by a cut-off wheel 61 as generally shown in FIGS. 1 and 7–9. FIGS. 1 and 8 clearly show that the entubed condition for the blocks of cheese 21 extends into the second conveyor 45. Severance of the wrap and separation of the blocks of cheese 21 takes place after the block being separated is already well supported in the conveyor 45.

The cut-off wheel 61 rotates in a clockwise direction as viewed in FIG. 7 and about an axis that generally parallels the line of travel for the blocks of cheese 21 through the conveyors 44 and 45. The wheel 61 is shown to carry a series of four (4) circumferentially and equidistantly spaced, radially extending knives 62. A radially extending wrap folding arm 63 is spaced axially to each side of the respective knives 62. With rotation of the wheel 61, the knives 62 are adapted to cut downwardly generally centrally through the taut necked down film wrap between adjacent blocks of cheese 21. Following severance of the film wrap, the wrap folding arms 63 engage with the severed ends 64 of the film wrap and fold them down generally normal to the blocks of cheese 21 as generally shown in FIG. 8. If desired, the knives 62 and wrap folding arms 63 might be oriented on the wheel 61 and adapted for reverse rotation to effect cut-off and folding with an upward stroke.

The cut-off wheel 61 is driven by the motor 65 through a suitable drive arrangement providing for alternate rapid acceleration and rapid stop. The wheel 61 carries a radial projection 66 generally centrally between adjacent knives 62. The projections 66 are successively engageable with a reciprocating stop 67 operable as by an electrically energized solenoid 68. The operation of the solenoid to withdraw the stop 67 from a given projection 66 for rotation of the wheel 61 to effect a cut-off will be appropriately timed by photoelectric or other sensing means, not shown, mounted on the frame 30.

The normally extending severed tube end 64 of the film wrap at the leading end of each block of cheese 21 is simply folded under the respective blocks as they enter the conveyor 45. At the trailing end of each block of cheese 21, the normally extending severed tube end 64 of the film wrap is forced into position under the respective blocks by a blast of air or other gas timely issuing from the nozzle 69 just prior to entry into the conveyor 45 as perhaps best indicated in FIG. 8. As the individual or separate blocks of cheese 21 advance along the heated conveyor 45, the heat serves to further shrink the plastic film wrap and thus drive more air from the packages, seal the severed tube ends 64, and secure the sealed tube ends to the film wrap on the downwardly facing sides of the blocks. The resulting packages thus contain minimal air to provide for a suitable shelf-life and generally preclude any adverse effect on the flavor and other qualities of the product. At the end of the conveyor 45, the individually wrapped blocks of cheese 21 are collected by means not shown.

If more heat is needed and/or desired, to effect shrinkage of the polyethylene or other similar plastic film wrap 23 and thereby exclude further air, a tunnel-like electric heater 70 as generally shown in FIGS. 10 and 11 may be relied upon. The heater 70 may be mounted on the frame 30 and interposed between the tube former 22 and the conveyor 44 as generally shown in FIG. 10. As generally shown in FIG. 12, heat may also be added by electrically heated rollers 71 which engage the opposed sides of the entubed blocks of cheese 21 as they pass through the conveyor 44. While only a pair of opposed rollers 71 are shown in FIG. 12, it should be understood that a plurality of longitudinally spaced heated rollers 71 could extend along opposed sides of the entire length of conveyor 44 (and/or conveyor 45) or of any portion of that length to provide additional heat. If desired, suitable rollers could replace the vertically opposed hot plates 59 and 60.

Figure 14:
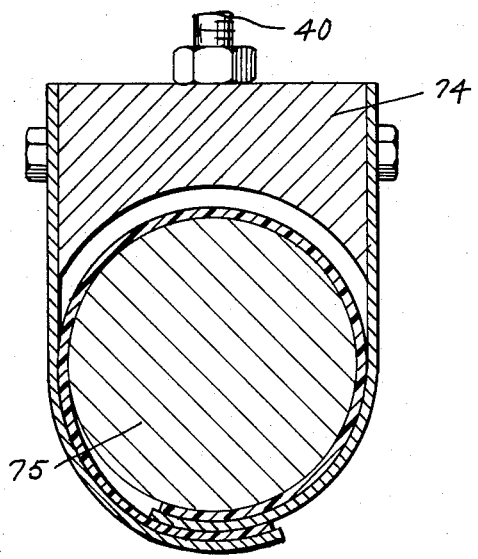
FIG. 14 is a sectional view showing a tube former element for a cylindrically shaped block of cheese.

Heretofore the wrapping process of this invention has been discussed only in connection with generally rectangular blocks of cheese 21. The polyethylene or other similar wrap material 23 may be used for other block configurations as well. FIG. 13 is a view generally similar to a portion of FIG. 4 and shows a tube former 72 for guiding wrap material 23 for enveloping or entubing wedge-shaped blocks of cheese 73. FIG. 14 shows a tube former 74 for entubing cylindrically-shaped blocks of cheese 75.

Figure 15:
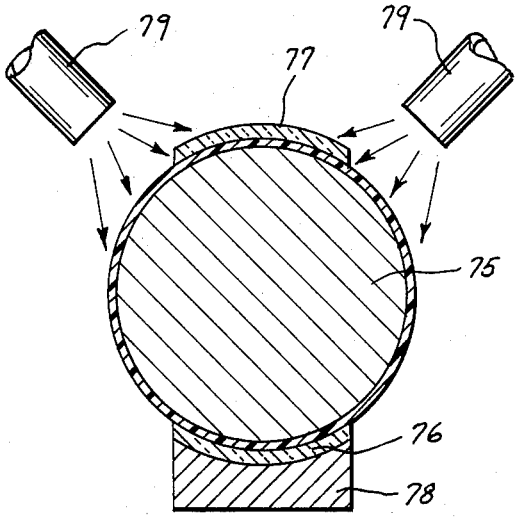
FIG. 15 is a sectional view of a film enveloped cylindrically-shaped block of cheese which is advanced between hot air nozzles to aid in shrinking the plastic film wrap.

According to the embodiment of FIG. 15, cylindrically-shaped blocks of cheese 75 are entubed and advanced between the endless conveyor belts 76 and 77. A hot plate 78 supports the lower conveyor belt 76. Additional heat to effect shrinkage of the wrap material is provided by hot air directed against the opposed upper quadrants of the tube formed by blowers 79. While only a pair of opposed blowers 79 are shown in FIG. 15, it should be understood that a plurality of longitudinally spaced blowers could extend along the entire length of the conveyor or any portion of that length.

Figure 16:
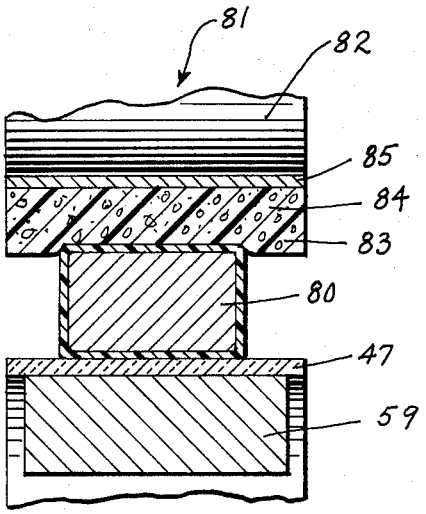
FIG. 16 is a view generally similar to that of FIG. 5 but wherein the upper endless belt includes a layer of sponge rubber as may be used for engaging the upper surface of random weight blocks of cheese.
Figure 17:
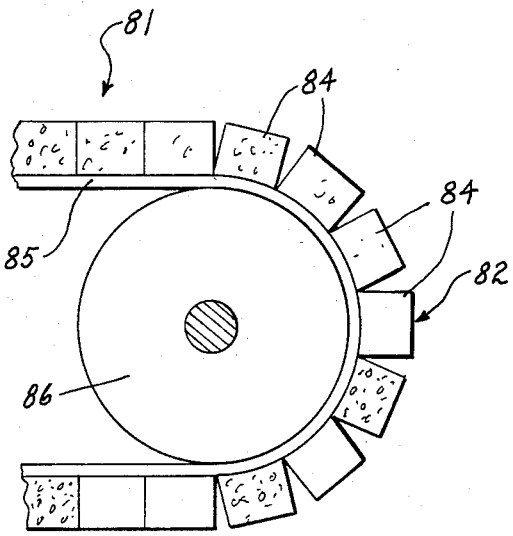
FIG. 17 is a partial detail view of the upper endless belt of FIG. 16 and showing the belt as being formed with blocks of sponge rubber.

The embodiment of FIGS. 16 and 17 contemplates the wrapping of random weight blocks of cheese 80. The blocks of cheese 80 all have a given length and width so as to be accommodated by a corresponding tube former 22 but will vary as to thickness or height to provide the blocks of random weight. The conveyor 81 of FIG. 16 includes a lower endless belt 47 the upper reach of which is supported by the plate heater 59 similarly as in the conveyor 44. The upper endless belt 82 of the conveyor 81, however, includes a layer 83 of sponge rubber which is adapted with the lower belt 47 to firmly grip the entubed blocks of cheese 80 of varying height. The layer 83 of sponge rubber presented by the lower reach of belt 82 may take the form of a plurality of blocks 84 of sponge rubber carried by a base belt member 85. While the blocks 84 act as a layer 83 of sponge rubber over the length of the lower reach of the belt 82 as generally shown in FIG. 17, the blocks are capable of moving over the pulley 86 in angularly spaced relation. Because the blocks 84 acting as a layer 83 of sponge rubber would serve as a barrier to heat from a plate heater disposed within the upper belt 82, heat for shrinking the wrap material 23 about the random weight blocks of cheese 80 may be supplied by a tunnel-like heater 70 of FIGS. 10 and 11 and/or the heated rollers 71 of FIG. 12. For accommodating of random weight blocks of cheese 80, the upper belt upstream from the cut-off wheel 61 must similarly include blocks 84 of sponge rubber that act as a layer 83 to help firmly grip the individual blocks of cheese of differing thickness or height.

The cost of plastic film wrapping material generally varies according to its thickness. Since the method and apparatus of this invention contemplates use of a very thin plastic film material on the order of 100 gauge or less, the cost of packaging ought to be very competitive. With the thin film wrap tightly shrunk onto the cheese, the packaged environment should include but minimal air to thus provide for a good shelf-life while maintaining flavor and other qualities. The tight film wrap will attractively display the product.

Various modes of carrying out the invention are contemplated as being within the scope of the following claims particularly pointing out and distinctly claiming the subject matter which is regarded as the invention.

I claim:

1. In apparatus for wrapping blocks of cheese, tube former means, means for feeding blocks of cheese in spaced relation into the tube former means, means for feeding a web of heat shrinkable and sealable plastic film wrap to the tube former means for entubement of the spaced blocks of cheese in an elongated tube of plastic film wrap, said film wrap including lateral edge portions of said web that overlap each other over the length of the tube, vertically spaced endless conveyors disposed between the tube former means and a cutoff station and sandwiching the entubed blocks of cheese therebetween with a gripping pressure, drive means for the endless conveyors for advancing the entubed spaced blocks of cheese from the tube former means to the cutoff station, heating means adjacent at least one of the endless conveyors whereby the endless conveyor passes between said heating means and said entubed spaced blocks of cheese such that said endless conveyor transfers heat from said heating means to said entubed blocks of cheese for heating the entubed blocks of cheese and thereby shrinking the plastic film wrap tightly onto surfaces of the blocks of cheese extending in the direction of travel to drive air out from between the cheese and the film wrap and sealing the overlapped edge portions of the wrap as the entubed blocks of cheese are advanced by the endless conveyors toward the cutoff station, means at the cutoff station for severing the tube corresponding to each block of cheese with the severance being effected intermediate the space between adjacent blocks and leaving each block with opposed severed tube ends, means for folding the severed tube ends against a surface of each wrapped block of cheese extending in the direction of travel, and means to heat the separate individually wrapped blocks of cheese to seal the respective tube ends together and against said surface.

2. The structure as set forth in claim 1 wherein the plastic film wrap is a polyethylene film having a thickness of 100 gauge or less.

3. The structure as set forth in claim 2 wherein the several heating means are capable of developing up to 220° F.

4. The structure as set forth in claim 1 wherein the tube former means provides for entubement of generally rectangular blocks of cheese.

5. The structure as set forth in claim 1 wherein the tube former means provides for entubement of generally wedge-shaped blocks of cheese.

6. The structure as set forth in claim 1 wherein the tube former means provides for entubement of generally cylindrically-shaped blocks of cheese.

7. The structure as set forth in claim 1 wherein nozzle means are associated with the tube former means and serves to purge the environment of the blocks of cheese with carbon dioxide or other suitable gas prior to entubement of the cheese.

8. The structure as set forth in claim 1 wherein the upper endless conveyor includes a plurality of outwardly disposed blocks of sponge rubber to accommodate and firmly grip blocks of cheese of random height.

9. The structure as set forth in claim 1 wherein heating means are associated with each of the endless conveyors and comprise electrically energized hot plates.

10. The structure as set forth in claim 9 wherein the hot plate associated with the lower conveyor serves to support the upper reach thereof, and the hot plate associated with the upper conveyor serves to support the lower reach thereof.

11. The structure as set forth in claim 9 wherein further heating means in the form of heating rollers serve to heat the transversely spaced side surfaces of the entubed blocks of cheese.

12. The structure as set forth in claim 1 wherein further heating means are interposed between the tube former means and the endless conveyors.

13. The structure as set forth in claim 12 wherein the further heating means between the tube former means and the endless conveyors is an electrically energized tunnel-shaped heater.

14. The structure as set forth in claim 1 wherein the heating means may additionally include hot air blowers for directing heated air against the entubed blocks of cheese.

15. The structure as set forth in claim 1 wherein a cutoff wheel is provided at the cutoff station and rotates on an axis that generally parallels the direction of travel for the blocks of cheese.

16. In a method for wrapping blocks of cheese comprising feeding the blocks of cheese in spaced relation to a wrapping station, feeding a web of heat shrinkable and sealable plastic film wrap to the wrapping station, enveloping the advancing spaced blocks of cheese at the wrapping station in an elongated tube formed from the plastic film wrap with the lateral edge portions of said web being disposed in overlapping relation over the length of the tube, advancing the entubed spaced blocks of cheese by vertically spaced endless conveyors that pass between the entubed spaced blocks of cheese and a heating means to heat said spaced endless conveyors such that said conveyors impose a gripping pressure on the blocks from the wrapping station to a cutoff station and said heated endless conveyors simultaneously heat the entubed spaced blocks of cheese to shrink the plastic film wrap tightly onto the blocks of cheese and thereby drive air out from between the cheese and film wrap and to seal the overlapped edge portions of the film wrap together, severing the tube corresponding to each block of cheese at the cutoff station with the severance being effected in the space between adjacent blocks and leaving each block with severed tube ends, folding the severed tube ends against a longitudinally extending surface of the wrapped block of cheese, and heating the separate blocks of cheese to seal the tube ends together and against said surface.

17. The method according to claim 16 including purging the environment of the blocks of cheese at the wrapping station and prior to entubement with a suitable gas to displace air from that environment.

* * * * *